United States Patent [19]

Dineen

[11] Patent Number: 4,487,020

[45] Date of Patent: Dec. 11, 1984

[54] POWER CONTROL FOR HEAT ENGINES

[75] Inventor: John J. Dineen, Durham, N.H.

[73] Assignee: Mechanical Technology Incorporated, Latham, N.Y.

[21] Appl. No.: 516,323

[22] Filed: Jul. 21, 1983

Related U.S. Application Data

[63] Continuation of Ser. No. 232,165, Feb. 6, 1981, abandoned.

[51] Int. Cl.[3] ..... F02G 1/06

[52] U.S. Cl. ..... 60/521; 60/525; 123/188 C

[58] Field of Search ..... 60/517, 518, 521, 522, 60/525; 123/65 VA, 188 C, 193 C, 193 CP

[56] References Cited

U.S. PATENT DOCUMENTS

| | | | |
|---|---|---|---|
| 1,823,770 | 9/1931 | Tartrais | 123/65 VA |
| 2,611,237 | 9/1952 | DeBrey et al. | 60/521 |
| 2,616,251 | 11/1952 | Rinia et al. | 60/521 |
| 3,533,429 | 10/1970 | Shoulders | 123/188 C |

*Primary Examiner*—Stephen F. Husar

*Attorney, Agent, or Firm*—Joseph V. Claeys; Arthur N. Trausch, III

[57] ABSTRACT

A power control arrangement for a Stirling engine includes a sleeve mounted in each cylinder for axial movement and a port in the sleeve leading to a dead space. The port is covered by the piston at a position that is determined by the piston position and the axial adjustment of the sleeve. The compression phase of the Stirling cycle for that piston begins when the port is covered, so the position of the sleeve is used to set the Stirling engine power level.

15 Claims, 10 Drawing Figures

240
242
238
230
244
264
266
274
252
246
272
258
260
270
234
236
248
262
250
276
254
256
232

194
199
205
192
206
198
190
207
220
212
219
200
196
208
209
210
211
214
216
218
222
204
202

POWER CONTROL FOR HEAT ENGINES

The government of the United States of America has rights in this invention pursuant to Contract No. DEN3-32 awarded by the Department of Energy.

This application is a continuation of application Ser. No. 232,165, filed Feb. 6, 1981, abandoned.

BACKGROUND OF THE INVENTION

This invention relates to power controls for heat engines, and more particularly to power control devices for double-acting Stirling engines.

The Stirling engine is widely believed by experts in the power field to have good potential for replacing the internal combustion engine in a considerable number of applications. The Stirling engine uses an external combustor which can be adjusted for efficient and clean combustion using a wide variety of fuels, including petroleum and non-petroleum liquids and a variety of solid and gaseous fuels. The engine itself is quiet, efficient, and has a good potential for a long maintenance period. For these reasons, a great deal of effort has been devoted to Stirling engine research and development in the recent past, and rapid improvement in this technology has occurred.

However, one of the areas in which improvements are still needed is in the power control area. The effective power control techniques that have been developed and adopted thus far are complicated, expensive, and unreliable. Moreover, they often impose an engine efficiency penalty at power levels below full power which, in some applications, represent the greatest proportion of use.

SUMMARY OF THE INVENTION

Accordingly, it is an object of this invention to provide a power control device for a heat engine which is simple, inexpensive, and reliable. According to another object, the invention provides a power control arrangement which enables the engine to operate with good efficiency under part-load operation. Yet a further object of the invention is to provide a power control system for a Stirling engine which is usable in many engine configurations and sizes. An additional object of the invention is to provide a power control device for a Stirling engine which has rapid response to control movement and requires little force to effect the control movement.

These objects are achieved in a preferred embodiment wherein the compression space of the engine has disposed therein a sleeve having ports which can be covered and uncovered at an adjustable position in the piston stroke to vary the effective compression space of the engine and thereby vary its power output.

DESCRIPTION OF THE DRAWINGS

The invention and its many attendant objects and advantages will become better understood upon reading the following description of the preferred embodiment in conjunction with the following drawings, wherein.

DESCRIPTION OF THE PREFERRED EMBODIMENT

Figure 1:
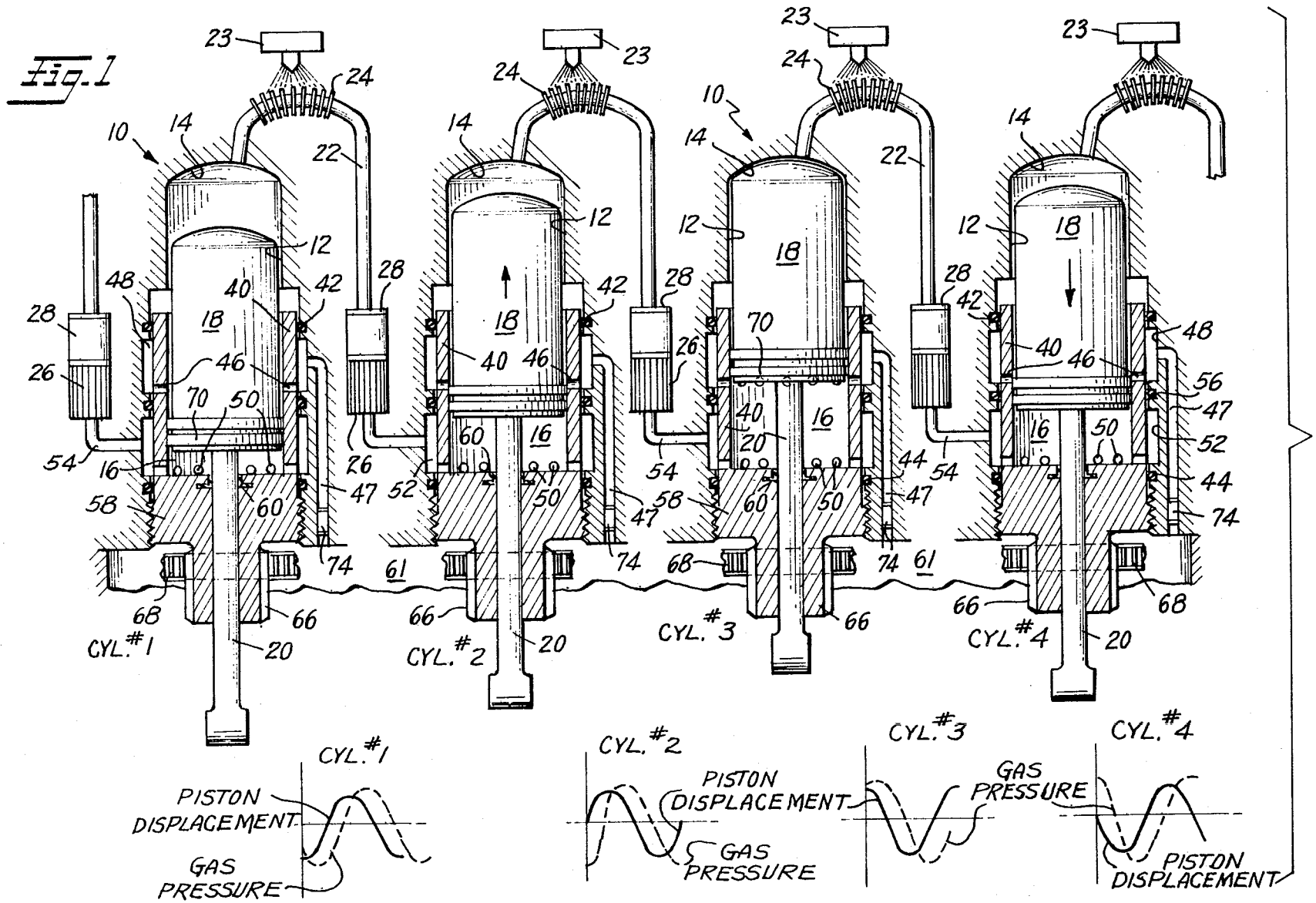
FIG. 1 is a schematic diagram of a double-acting Stirling engine incorporating the inventive power control.

Referring now to the drawings wherein like reference characters designate identical or corresponding parts and more particularly to FIG. 1 thereof, a double-acting Stirling engine is shown including an engine block 10 having formed therein four cylinders 12 each including an expansion space 14 and a compression space 16. A piston 18 having a piston rod 20 is mounted for axial reciprocation in the cylinder 12. A gas conduit 22 connects the expansion space 14 of each cylinder with the compression space 16 of the adjacent cylinder. A combustor 23 heats the working gas in a heater section 24 adjacent to the expansion space 14 and a cooler 26 cools the working gas adjacent to the compression space 16. A regenerator 28 is disposed in the gas flow path for storing heat as the gas flows from the expansion space 14 to the compression space 16, and for returning the stored heat to the working gas as the gas flows from the compression space 16 to the expansion space 14. The piston rod 20 is connected at 30 to a reciprocating-to-rotating motion conversion device such as a wobble hub of the type illustrated in my copending patent application now U.S. Pat. No. 4,372,116, issued Feb. 8, 1983, the disclosure of which is incorporated herein by reference.

The operation of the double-acting Stirling engine, or Siemens engine is known in the art and the following description will merely outline the thermodynamic cycle for purpose of relating the present invention to the known engine. Piston No. 1 is shown at bottom dead center. As it commences upward movement, it displaces working gas from the expansion space 14 into the gas conduit 22, passing serially through the heater 24, the regenerator 28, and the cooler 26, and into the compression space 16 of cylinder No. 2. The piston in No. 2 leads the piston in cylinder No. 1 by 90° and therefore, is at the piston midstroke position (MSP) moving toward TDC.

The volume in the working space represented by the expansion space 14 of cylinder No. 1 and the compression space 16 of cylinder No. 2 is, therefore, increasing by virtue of the differential movement of the pistons, and the pressure is falling because of the increasing volume and the drop in temperature as the gas moves downward through the heat exchangers 28 and 26. The piston in cylinder No. 3 has reached top dead center and therefore, the compression space 16 in its cylinder is at maximum volume and its expansion space 14 is at minimum volume. The piston in cylinder No. 4 is at MSP moving downwardly and the gas pressure in the expansion space is near maximum. The crank angle of crank No. 4 is about 90° so the torque from No. 4 piston is near maximum. Because of the phase relationship between the pistons and the crank angle, power is extracted from the engine during the expansion phase in each cylinder and power is returned to the cycle in the compression phase of each cylinder, but the power output is greater than the power input resulting in a net power output from the engine.

One of the parameters of the Stirling engine operation which affects engine power is the volume of gas moved through the heat exchangers 24, 26, and 28. This invention provides a means for adjusting the volume of gas circulated through the heat exchangers by controlling the initiation of the compression phase of the Stirling cycle. The technique essentially is to provide a dead volume pressurized to the engine cycle minimum or charge pressure, and port the compression space to this dead volume until a certain piston stroke position is reached in the cycle, at which time the dead volume is closed off and the remaining gas in the working space is compressed in the normal Stirling cycle. The portion position is adjustable to allow the position at which compression commences to be adjusted.

Figure 2:
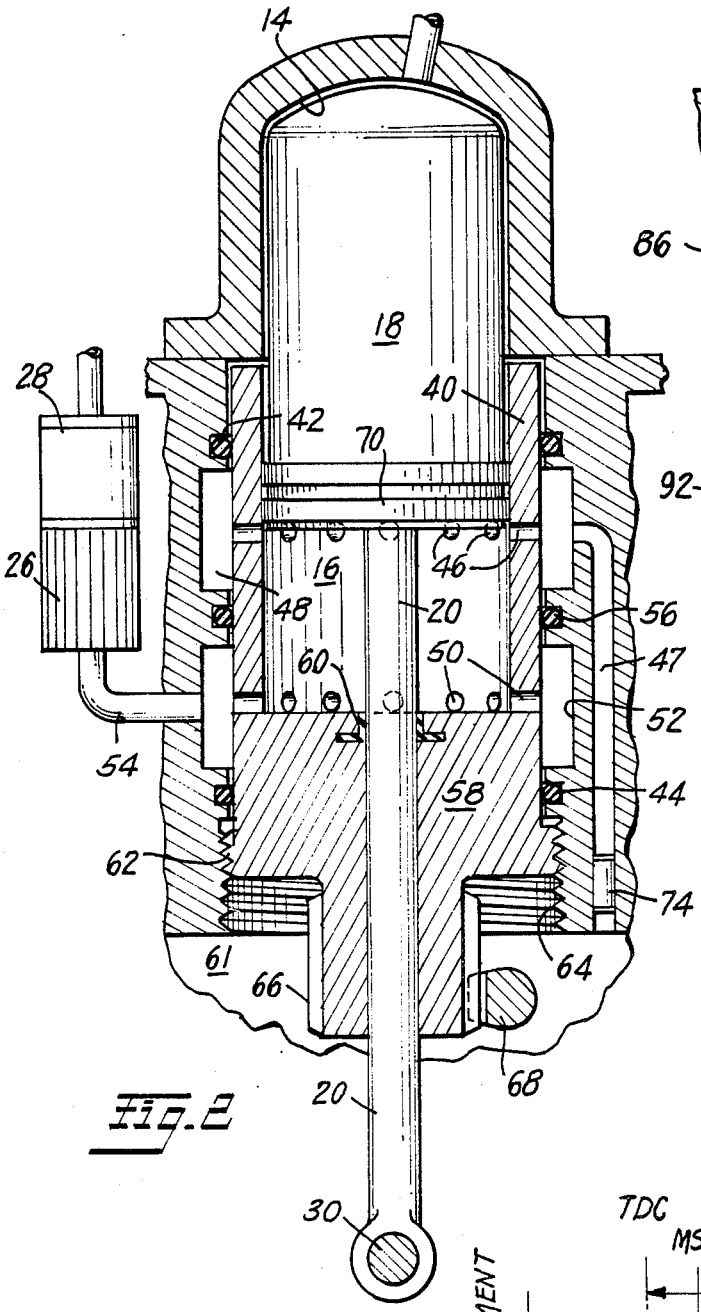
FIG. 2 is an enlarged sectional elevation of one of the cylinders in the engine illustrated in FIG. 1.

The technique for accomplishing this invention in the preferred embodiment of FIGS. 1 and 2 is a sleeve 40 which is mounted in each of the cylinders 12 for axial movement therein. The structure of each cylinder and its associated parts is identical, and therefore, the following description of cylinder No. 1 will apply equally to cylinder Nos. 2–4. A seal 42 in the cylinder 12 at the top of the sleeve 40 prevents leakage of pressurized working gas from the working space between the cylinder 12 and the sleeve 40, and a similar seal 44 at the bottom of the sleeve 40 prevents leakage of working gas between the cylinder 12 and the sleeve 40. A set of ports 46 extends through the sleeve 40 communicating between the compression space 16 and an annular manifold 48 formed in the engine block in alignment with the ports 46 and of sufficient axial height to align with the ports 46 throughout the full range of axial movement of the sleeve 40, as explained below. A gas passage 47 connected the manifold 48 with a closed gas chamber pressurized with engine working gas to the charge or cycle minimum pressure, for a purpose to be explained below. A second set of ports 50 communicates between the compression space 16 and a second annular manifold 52 which in turn communicates via a conduit 54 with the cooler 26. A seal 56 is disposed in the cylinder wall between the manifold 48 and manifold 52 to prevent leakage of working gas between the two manifolds.

The sleeve 40 is connected to and extends upwardly from a piston rod seal housing 58. The housing 58 contains a piston rod seal, shown schematically at 60, which prevents leakage of pressurized working gas between the piston rod and the seal housing 58 into the crankcase 61. The details of the seal 60 are not relevant to the present invention and any adequate piston rod seal may be used with this invention.

The seal housing 58 includes an externally-threaded lower end portion 62 which is threadedly engaged with an internally-threaded lower end portion 64 of the cylinder 12 so that rotation of the seal housing 58 about its axis will cause axial translation of the seal housing and the attached sleeve 40 as the threads 62 travel in the threads 64.

The mechanism for rotating the seal housing 58 includes a spur gear 66 integrally attached to the lower end of the seal housing 58 and having vertically elongated teeth which engage a toothed rack 68 such that longitudinal movement of the rack 68 (in the direction into or out of the plane of FIG. 2) causes rotation of the spur gear 66 and hence rotation of the seal housing 58. The vertical elongation of the teeth on the spur gear 66 are to ensure that the spur gear will engage the rack 68 at all axial positions of the seal housing 58 throughout its entire range of movement axially. If desired, the spur gear 66 and rack 68 may be replaced with a helical gear and a worm gear so that the worm gear may be journaled for rotation about its axis in engagement with the helical gear to cause the helical gear to rotate about its vertical axis and cause the seal housing 58 to translate axially.

The operation of the power control will now be described. At the maximum axial elevation of the sleeve 40, the piston ring 70 will just clear the ports 46 in the sleeve 40 at the top dead center position of the piston 18. As the piston commences its downward compression stroke, the ports 46 will be closed by the piston ring 70 and the full volume of the compression space 16 will be effective. That is, all of the gas in the compression space 16 will be subjected to the Stirling cycle. When the seal housing 58, and hence the sleeve 40, is moved axially downward through the cylinder 12, the axial position of the ports 46 moves downwardly and therefore, the ports remain open until the piston ring 70 covers them. During the period in which the ports 46 are open, the gas displaced from the compression space 16 is primarily vented to the closed gas chamber maintained at the charge gas pressure of the engine working gas. Thus, most of the working gas will be vented to this chamber and will not be subjected to the compression, heating, expansion and recooling of the Stirling cycle. The compression phase of the Stirling cycle commences only when the ports 46 are closed by the piston ring 70. The effect is to reduce the volume of working gas which is circulated through the heat exchangers and therefore, reduce the amount of energy which is extracted from the heater. The engine power is correspondingly reduced.

The engine crankcase 61 is used in this embodiment as the closed gas chamber. To prevent oil from travelling through the passage 47 and into the engine working space, an oil separator 74 is located in the passage 47 for removing oil mist from the working gas which flows back into the compression space 16 during the upward stroke of the piston after it clears the ports 46. The crankcase is used as the gas chamber merely as a convenience because it is present and available for such use. However, a separate gas chamber may be employed to eliminate altogether the danger of oil contamination in the engine working space and obviate the need for the coil removal device 74. Alternatively, sealed grease lubricated bearings may be utilized to obviate the need for oil in the crankcase 61 and thereby eliminate the danger of oil contamination of the engine working space.

Figure 3:
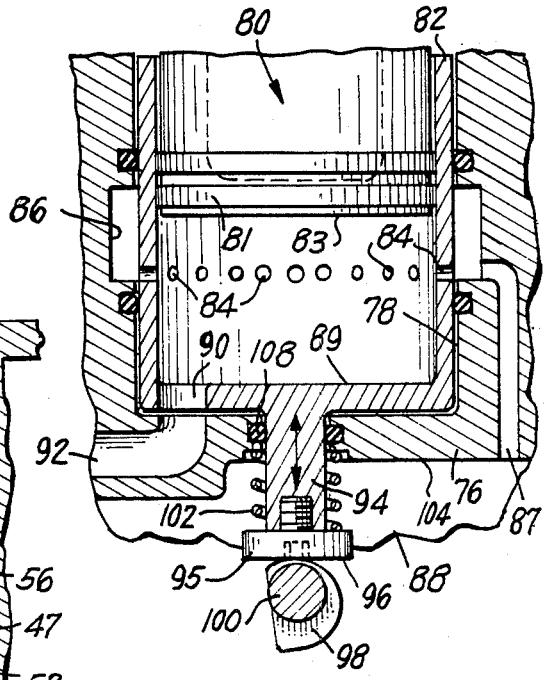
FIG. 3 is a sectional elevation of a portion of the piston and cylinder of a second embodiment of this invention.

Referring now to FIG. 3, the invention may be embodied in a Stirling engine having a power take-off connection at the center position of the piston. Because there is no piston rod extending from the end of the piston, the control mechanism for adjusting the axial position of the sleeve in the cylinder may be located at the end of the cylinder. The engine of the embodiment of FIG. 3 includes an engine block 76 having formed therein a plurality of cylinders 78, each containing an axially reciprocating gas acting device, or piston 80 having piston rings 81 adjacent its cold face 83. A sleeve 82 is slidably disposed in the cylinder 78 and has formed therein a set of ports 84 communicating with a manifold 86 in the cylinder 78. The axial length of the manifold 86 is sufficient to maintain communication between the manifold 86 and the interior of the sleeve by way of the ports 84 at all axial positions of the sleeve 82 throughout its full range of motion, as described below. A conduit 87 connects the manifold 86 with a closed chamber such as the engine crankcase 88 or a separate closed gas chamber dedicated to this purpose.

The lower end of the sleeve 82 has a bottom or web 89 which has formed therein an opening 90 which communicates at all axial positions of the sleeve 82 with a gas passage 92 connected to a cooler (not shown). The web 89 has attached thereto a control stud 94 having an enlarged end bottom 95 with a hardened end face 96. A cam 98 mounted on a cam shaft 100 controls the axial position of the stud 94. The angular position of the cam 98 determines the radial distance from the axis of the camshaft 100 to the surface of the cam 98 where it bears against the face 96 of the button 95. A coil spring 102 is biased between the top face 104 of the crankcase 88 and the shoulder formed at the junction of the button 95 with the control stud 94 to return the control stud 94 and the sleeve 82 back toward the cold end of the working space of the engine when the cam 98 is rotated to present a smaller radius to the button face 96. A seal 108 is provided in the engine block around the hole in which the control stud 94 moves to prevent leakage of gas from the opening 90 into the crankcase 88.

In operation, the position of the sleeve 82 is adjusted by selective angular positioning of the cam 98 on the camshaft 100. At the position illustrated in FIG. 3, the sleeve is positioned at its extreme position into the cold end of the working space which locates the ports 84 at their most extreme position toward the cold end of the working space. This position results in the smallest effective compression volume and therefore, the smallest volume of working gas actually circulated through the heat exchangers. This is because the piston 80 must travel the distance illustrated in FIG. 3 between the cold face 83 of the piston 80 and the ports 84 before the piston rings 81 close the ports and the compression phase of the Stirling cycle can actually commence. This initial travel of the piston merely results in a transfer of working gas out of the compression space, through the ports 84 and the manifold 86 and passage 87 and into the closed gas chamber 88. Therefore, this volume of gas which flows into the chamber 88 is not compressed to be available for later expansion in heated form in the expansion chamber to produce power in the Stirling cycle, but is merely transferred without pressure or temperature change.

Figure 4:
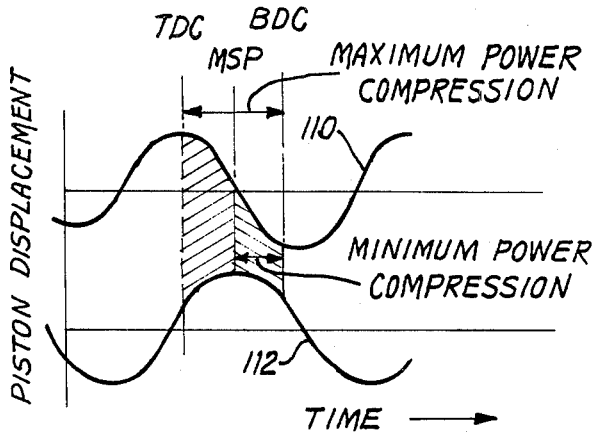
FIG. 4 is a displacement graph of a Stirling engine made in accordance with this invention.

FIGS. 4 and 5 illustrate the effect of the variation of port position on engine power. The top curve 110 is a time-displacement graph of the piston 80 in the embodiment of FIG. 3, or the piston in cylinder No. 3 in the embodiment of FIG. 1. A lower curve 112 in FIG. 4 represents the displacement over time of the adjacent plston, not illustrated in FIG. 3 or the piston in cylinder No. 2 in the embodiment of FIG. 1. As shown, the compression piston notion shown by the curve 110 is leading by 90° the power piston motion illustrated in curve 112.

With the sleeve 82 adjusted to the position illustrated in FIG. 3 so that the ports 84 are at their most extreme axial position toward the cold end of the working space, the piston 80 must move almost entirely to its midstroke position noted as MSP on the top curve before the actual compression of the gas in the compression space commences. At the midstroke position, the piston ring 81 on the piston 80 covers the ports 84 and the compression of the gas between the compression piston and expansion or power piston begins. The gas is compressed and displaced through the heat exchangers where its temperature and pressure is raised to produce a power pulse on the power piston whose position is represented by the curve 112 in FIG. 4. Thus, the amount of heat that can be transferred to the circulating working gas is reduced from the maximum value to the minimum value because the mass flow of gas through the heat exchanger is reduced and the degree of compression of the working gas is also reduced.

When the sleeve 82 is adjusted to its most extreme axial position toward the expansion space, the ports 84 are closed at the top dead center position of the piston 80 by the piston rings 81. In this way, the effective compression space, that is the volume swept by the piston whose gas is transferred through the engine heat exchangers, is at a maximum. As shown in FIG. 4, in the sectioned area (which also includes the cross hatched area of the effective compression space at minimum power) the effective compression volume and the degree of compression of the gas is greatly increased. For this reason, the mass of working gas circulating through the heat exchangers is maximized and the power extracted from the heater, which is available for conversion to work in the Stirling cycle, is maximized. The intermediate positions of the ports 84 will produce intermediate power levels from the engine.

Figure 5A:
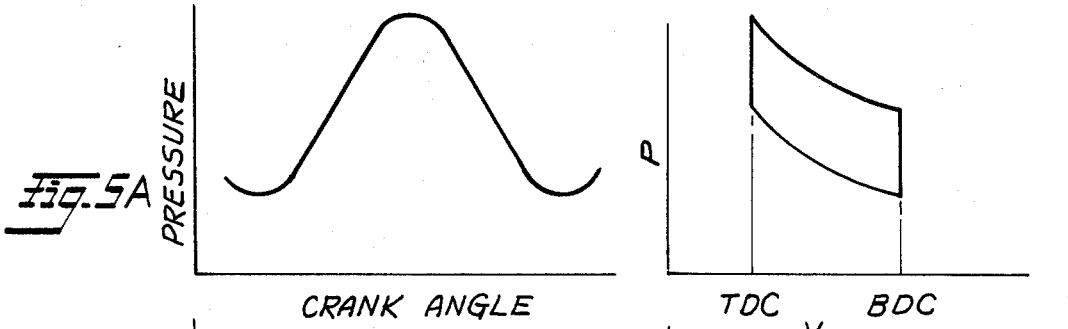
FIGS. 5A and 5B are gas pressure/crank angle graphs of the engine illustrated in FIG. 1.
Figure 5B:
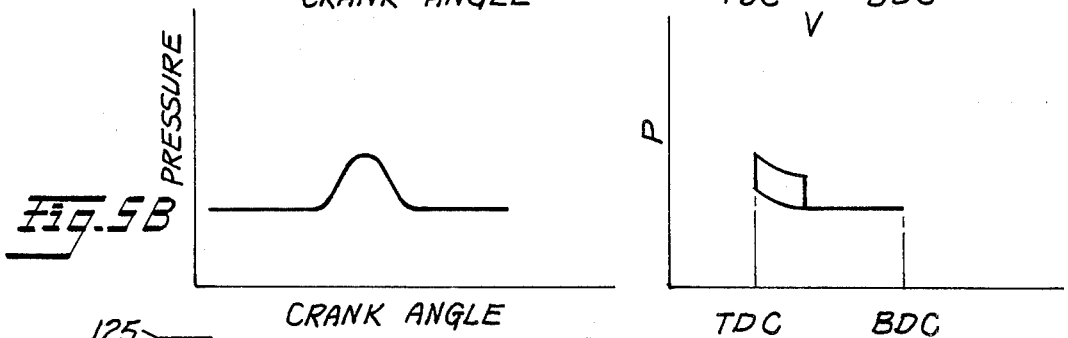

As shown in FIG. 5A, the pressure wave which acts on the power piston to produce output power is much greater and extends over a greater degree of crank angle when the effective compression space volume is maximum than the pressure wave produced by the engine when the compression space is minimized by the adjustment of the ports 84 toward the cold end, as illustrated in FIG. 5B. The corresponding P-V diagram is of much greater area. The power output of the cycle is thus much greater in the situation illustrated in FIG. 5A.

Figure 6:
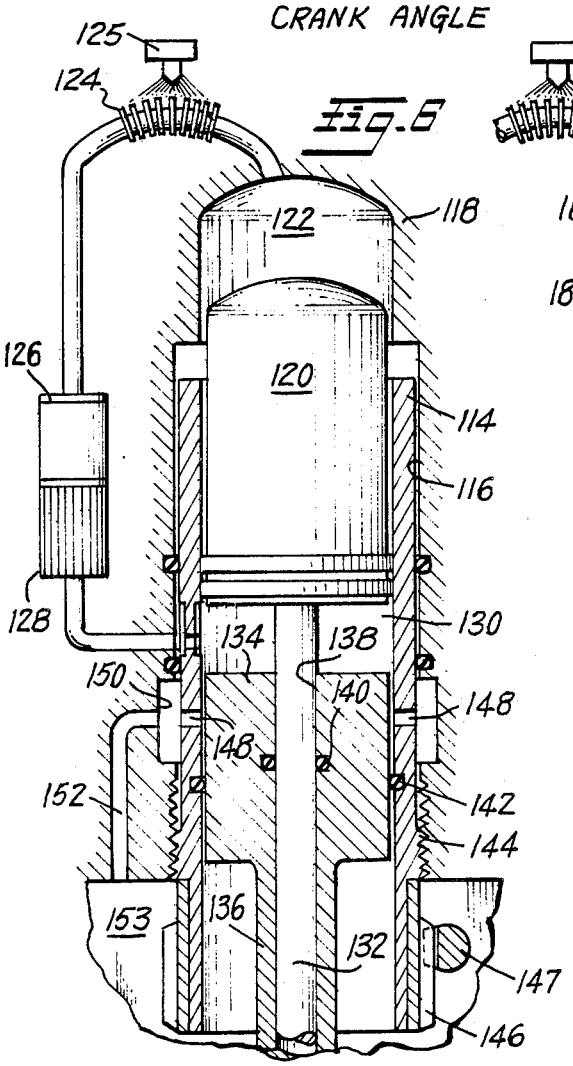
FIG. 6 is a schematic elevation of a third embodiment of this invention in the form of a displacer/piston Stirling engine.

Turning now to FIG. 6, a third embodiment of the invention is illustrated in which the power control device is incorporated in a displacer/piston Stirling engine. The control sleeve 114 is axially adjustable in a cylinder 116 of the engine block 118. Gas acting means including a displacer 120 is mounted for axial oscillation in the cylinder 116 to displace working gas from the expansion space 122 of the working space through a heater 124 heated by a combustor 125, a regenerator 126, a cooler 128 and into the compression space 130 of the working space. The displacer 120 has a displacer rod 132 connected to a mechanism (not shown) such as crank which causes it to reciprocate in the working space with a regular harmonic motion. The other portion of the gas acting means includes a power piston 134 likewise mounted in the cylinder 116 for axial reciprocation therein, lagging the displacer by about 90°. The power piston 134 has attached thereto a tubular piston rod 136 for transmitting output power to a motion conversion mechanism such as a crank or rhombic drive device. An axial bore 138 extends through the piston 134 and rod 136 and receives the displacer rod 132 with a sliding fit. A seal 140 in the bore 138 of the power piston 134 prevents leakage of working gas between the displacer rod 132 and the power piston 134, and a second seal 142 in the inside surface of the control sleeve 114 prevents leakage of working gas between the control sleeve 114 and the power piston 134.

The sleeve 114 is axially adjustable in the cylinder 116 by means of a translation mechanism including a threaded lower end portion 144 of the sleeve 114 and a spur gear 146 attached to the lower end of the sleeve 114. A toothed rack 147 engages the spur gear 146 in the same manner as the embodiment of FIGS. 1 and 2 to produce movement of the control sleeve 114.

The sleeve 114 includes a set of control ports 148 which communicate with an annular manifold 150 in the cylinder 116. A gas passage 152 connects the manifold 150 with a closed gas volume maintained at the engine charge pressure such as the engine crankcase 153 or another closed volume dedicated to this purpose. The axial position of the ports 148 determines the commencement of the compression phase of the Stirling cycle and hence the output power of the engine.

Figure 7:
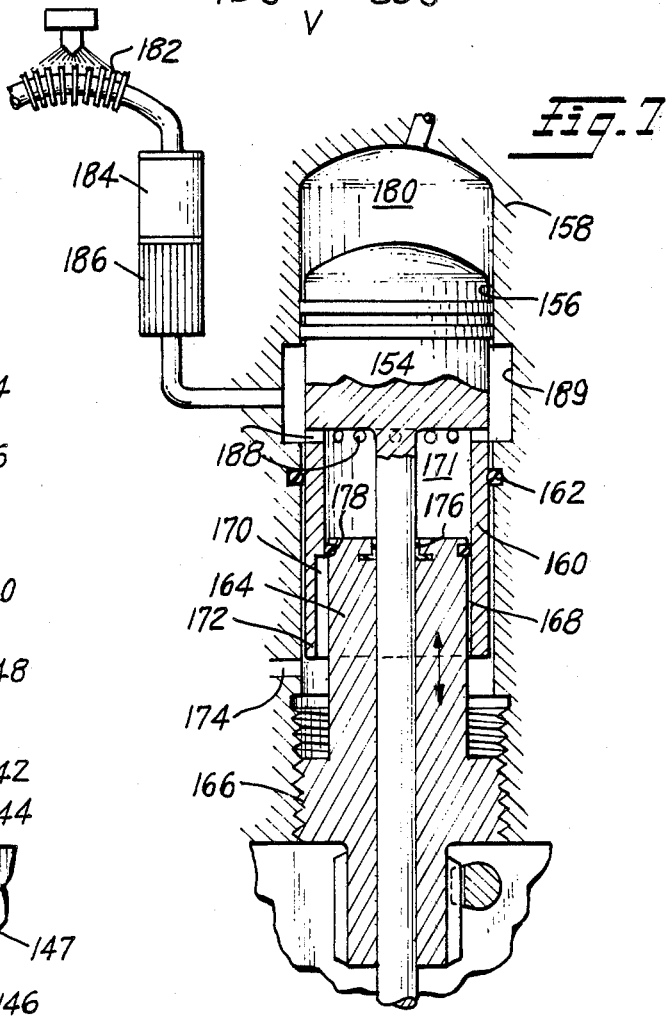
FIG. 7 is a schematic elevation of a fourth embodiment of this invention in the form of a double-acting Stirling engine.

Turning now to FIG. 7, a fourth embodiment of the invention is shown in the form of a double-acting Stirling engine having gas acting means including a piston 154 mounted for reciprocation in a cylinder 156 formed in an engine block 158. The piston 154 includes a depending skirt 160 which is coaxially disposed within the cylinder 156 and engages a seal 162 in the wall of the cylinder 156 to prevent leakage of high pressure working gas from the cylinder 156. A control member 164 is threadedly engaged in the cylinder 156 by virtue of a lower threaded end portion 166. Axial movement of the control member 164 is effected by the same structure which is used and disclosed in connection with the embodiment of FIGS. 1 and 2. The upper end of the control member 164 is radially relieved at 168 to produce a smaller diameter upper portion.

A groove 170 is formed in the inner surface of the depending skirt 160 for gas flow to and from the compression space 171 defined between the top face of the control member 164 and the bottom face of the piston 154 where it connects to the depending skirt 160. The groove 170 communicates between the compression space 171 and an annular manifold 172 defined between the reduced diameter portion 168 of the control member 164 and the cylinder 156. A gas passage 174 connects the manifold 172 and an engine crankcase or to another closed gas chamber dedicated to the purpose described previously for the closed gas chamber. A piston rod seal 176 is contained in the control member 164 and a seal 178 is provided in the top outer periphery of the control member 164 to seal the compression space after the gas passage groove 170 has cleared the top of the control member 164.

In operation, the piston oscillates axially within the cylinder 156 causing a cyclic change in the volume of the compression space 171 and the expansion space 180 above the top of the piston 154. Movement of the piston 154 causes the working gas contained within the compression space 171 and the expansion space 180 to be circulated through the heat exchangers, that is, a heater 182, a regenerator 184, and a cooler 186 to cause a pressure wave in the working gas and output power, in the manner known for the double-acting configuration of a Stirling engine. As the piston 154 descends relative to the control member 164, the gas in the compression space 171 is expelled through the gas passage groove 170, into the manifold 172, thence out the gas passage 174 to the enclosed gas volume (not shown). There is thus little or no gas compression or gas circulation through the heat exchangers. When the upper end of the groove 170 passes the top of the control member 164, the compression of gas in the compression space 171 can commence and gas can begin to circulate through the heat exchangers, in the known manner. The compressed gas flows through a port 188 in the sleeve 160 and into a manifold 189 which is of such axial height as to align with the ports 188 at all axial positions of the piston 154. Thus, the commencement of the compression phase of the Stirling cycle can be adjusted by virtue of the axial position of the control member 164 and therefore, the engine power can be so adjusted.

Figure 8:
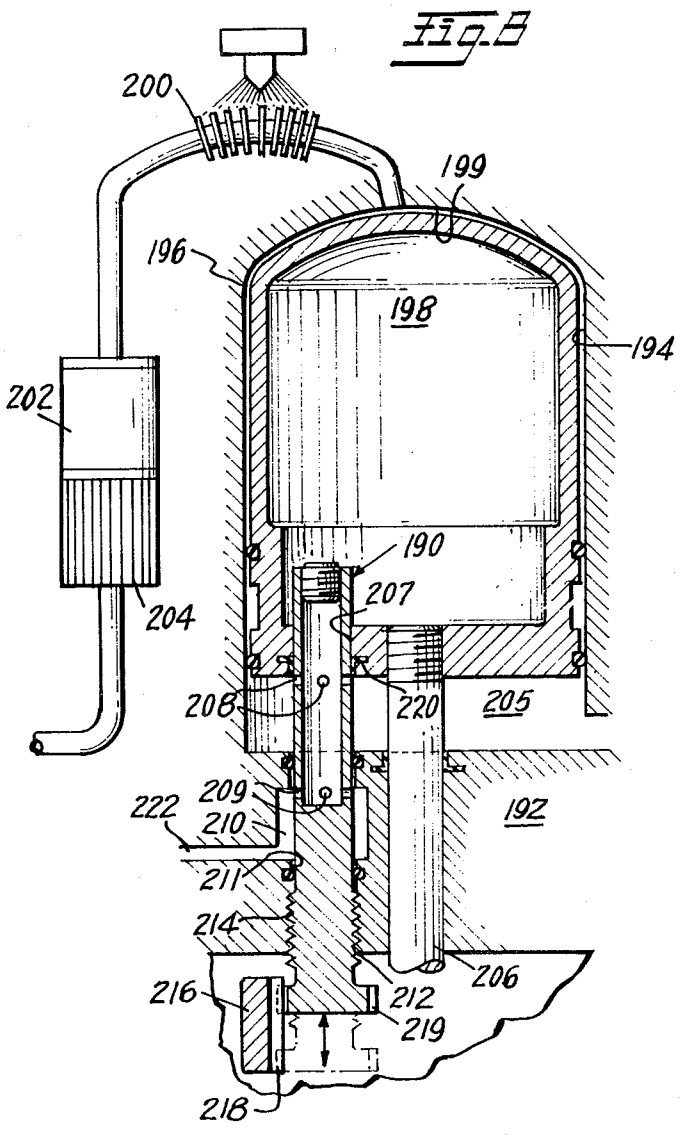
FIG. 8 is a schematic elevation of a fifth embodiment of this invention made in the form of a double-acting Stirling engine.

Turning now to FIG. 8, the fifth embodiment of the invention employs a control tube 190 mounted for axial movement in the floor 192 of the cylinder 94 formed in the engine block 196. A piston 198 reciprocates axially in the cylinder 194 relative to the tube 190 to circulate working gas from the expansion space 199, through a heater 200, a regenerator 202 and a cooler 204 and into the compression space 205 of the adjacent cylinder. The tube 190 extends through a hole 207 in the lower end face of the piston. The piston 198 includes a piston rod 206 by which power is transferred to a reciprocating-to-rotating motion conversion device, for example like that shown in the embodiment of FIGS. 1 and 2. The general operation of this embodiment is a double-acting Stirling engine which in its overall operation is the same of that shown of that embodiment of FIGS. 1 and 2.

A set of ports 208 extend through the tube 190 and communicate between the compression space 205, through the interior of the tube and a second set of ports 209 to an annular manifold 210 formed in the bore 211 in which the tube is mounted. The axial height of the manifold 210 is sufficient to maintain communication between the ports 209 and the manifold 210 at all axial positions of the tube 190, as explained below.

A tube translation mechanism includes a threaded portion 212 at the bottom of the tube 190 which treadedly engages an internally threaded portion 214 in the bore 211. Rotation of the tube 190 will cause the sleeve to move axially in the bore 211 depending on the direction of rotation. Rotation of the tube is achieved by lateral movement of a toothed rack 216 supported in the crankcase. The rack has a set of vertically elongated teeth 218 which engage a spur gear 219 attached to the lower end of the tube 190 so that lateral movement of the rack 216 causes the tube 190 to rotate and translate vertically in the bore 211.

In operation, the piston 198 oscillates axially in the cylinder 194 and on the stationary tube 190 to cause cyclic circulation of the working gas through the heater 200, the regenerator 202, and the cooler 204 to create a pressure wave in the working space of the engine. This pressure wave is the means by which heat energy is converted to kinetic energy of the piston. The commencement of the compression phase and hence the power produced in the Stirling cycle is controlled by the axial position of the tube 190, and in particular by the axial position of the ports 208 in the tube 190. With the tube at its extreme axial position toward the hot space of the engine, that is, in its uppermost position in FIG. 8, the effective compression space of the engine is maximized and the quantity of working gas circulated through the heat exchangers is likewise maximized. With the sleeve tube in its extreme axial position toward the cold end of the engine, that is, at its lowermost position in FIG. 8, the effective compression space volume is minimized because the ports 208 are not closed by the piston rings 220 until the piston has descended some significant portion, for example half, of its stroke. Until the ports 208 are closed by the piston ring 220, the gas being displaced in the compression space 205 can flow through the ports 208, the tube 190, the ports 209 and the manifold 210 and through a passage 222 into an enclosed gas volume such as the engine crankcase or a separate volume provided for that purpose.

Figure 9:
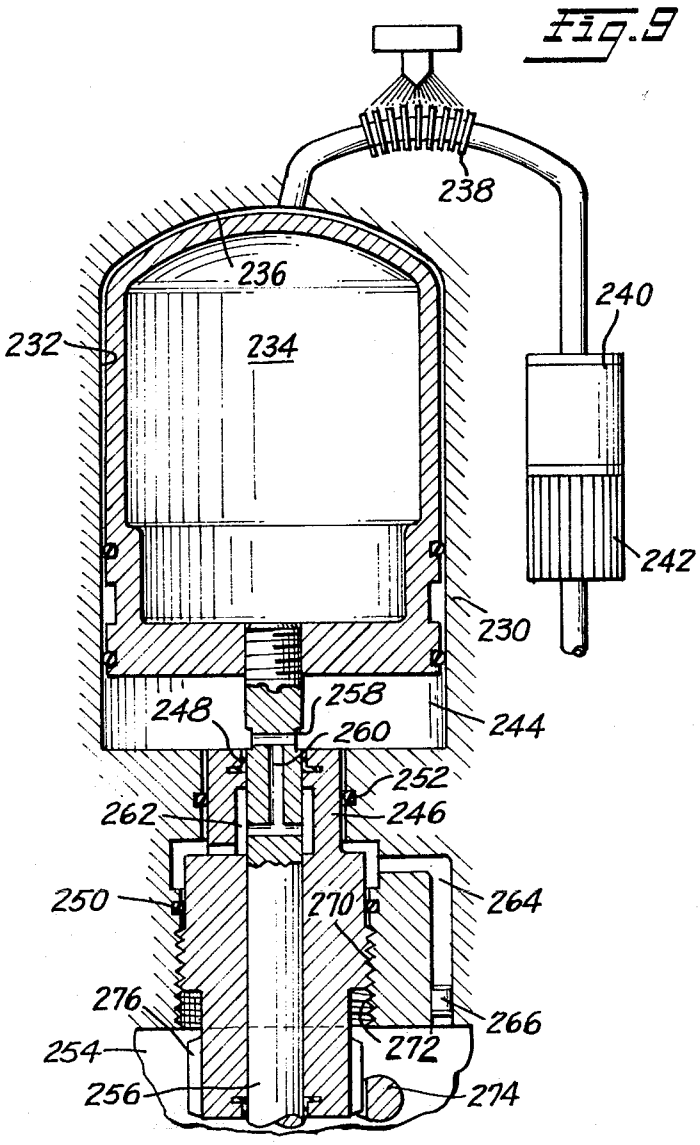
FIG. 9 is a schematic elevation of a sixth embodiment of this invention, also in the form of a double-acting Stirling engine.

Turning now to FIG. 9, a sixth embodiment of the invention is shown in a double-acting Stirling engine including an engine block 230 having formed therein a plurality of cylinders 232, only one of which is shown in FIG. 9. A piston 234 is mounted for axial reciprocation in the cylinder 232 under the influence of a pressure wave created in the expansion space 236 of the cylinder when the working gas is circulated through a heater 238, a regenerator 240, a cooler 242 and into the compression space 244 of the adjacent cylinder in the known mode of operation of a double-acting Stirling engine.

A seal housing 246 is disposed in the cold end of the cylinder 232, that is, in the lower end as shown in FIG. 9. The seal housing 246 includes a seal arrangement shown schematically as seals 248, 250, and 252 which prevent leakage of pressurized working gas from the compression space 244 in the cylinder 232 into the engine crankcase 254, and prevent migration of oil from the crankcase 254 into the compression space 244 of the cylinder 232.

The piston 234 has a piston rod 256 which is connected to a reciprocating-to-rotating motion conversion mechanism such as a swash plate. The piston rod 256 has an annular groove 258 near the connection of the piston rod 256 with the piston 234. A gas passage 260 extending through the piston rod 256 connects the groove 258 with a manifold 262 formed on the piston rod in continuous communication with a gas passage 264 which leads to the engine crankcase by way of an oil separator 266. The gas passage 264 communicates with the engine crankcase 254.

The mechanism for adjusting the axial position of the seal housing 246 in the cylinder 232 includes a threaded portion 270 at the bottom of the seal housing which threadedly engages an internally threaded portion 272 of the wall of the cylinder 232. In this way, rotation of the seal housing 246 relative to the engine block 230 will cause the seal housing to translate axially up or down in the cylinder 232 depending on the direction of rotation. The rotation of the seal housing 246 is achieved by the lateral movement of a toothed rack 274 which is threadedly engaged with a spur gear 276 non-rotatably attached, for example by welding or integrally formed, on the seal housing 246. The axial height of the teeth on the spur gear 276 is sufficient to accommodate axial movement of the seal housing 246 and maintain threaded contact between the rack 274 and the spur gear 276 throughout full range of axial movement of the seal housing 246.

The operation of the sixth embodiment shown in FIG. 9 is similar to the other embodiments. As the piston 234 descends into the compression space 244, it displaces cold working gas through the gas passage 260 and into the manifold 262 in the seal housing 246. From there the gas passes through the gas passage 264 and to the crankcase 254 which acts as a confined gas volume held at approximately the charge pressure of the working gas. This portion of the working gas is, therefore, not circulated through the engine heat exchangers and no energy is transferred from the heater to the engine working gas. When the groove 258 on the piston rod 256 passes into the seal housing 246 the compression phase of the Stirling cycle commences and the gas can be circulated through the heat exchangers in the known Stirling cycle. The seal housings in every cylinder of the engine are adjusted to the same axial position so that the commencement of compression in the engine cycle is at the same position in each cylinder so that the power developed in each cylinder is completely balanced. This is effectively accomplished by a simple mechanical linkage between the main power control adjustment lever (such as an automobile accelerator pedal) and the toothed rack 274 which can connect all four cylinders and therefore, accomplish the adjustment simultaneously and uniformly.

The power control of this invention provides a simple and reliable mechanical means for adjusting the power of a Stirling engine, and it eliminates the complicated, and expensive, and unreliable apparatus of the prior art power control contraptions. It requires very low force to achieve control motion and can be easily spring biased to move spontaneously to the low power or no power position in the case of failure. The control contributes to the efficicency of the engine system because at low power levels, the volume of working gas circulated to the heat exchangers is minimized, thereby minimizing the windage losses of the gas through the heat exchangers and also minimizing heat conduction loss and hysteresis losses of the regenerator. The control is very fast acting in its response and can be made to move from zero to full power in a few moments by the simple movement of a control rod. There are no losses associated with change in power level and it is possible to alternate repeatedly between low power and full power without any time lag or efficiency penalty or recovery time required.

Obviously, numerous modifications and variations of the disclosed embodiment will occur to those skilled in the art.

Therefore, it is expressly to be understood that these modifications and variations, and the equivalents thereof, may be practiced while remaining in the spirit and scope of the invention as defined in the appended claims, wherein I claim:

1. A power control for a heat engine having an engine block defining therein a cylinder, a piston received within said cylinder in which working gas can expand at the high cycle temperature to produce a power stroke of said piston, and in which said piston can compress working gas at the low cycle temperature in a compression volume, said power control comprising:

a control member disposed in said engine block and movable axially with respect to both said piston and said engine block, wherein said control member is cylindrical and coaxially disposed with respect to said piston, and includes means in said control member defining a cylindrical bore therethrough, said bore receiving structure attached to said piston;

means defining a gas passage that is positioned to communicate at one end thereof with said compression volume at some positions of said control member and said piston, and to be closed by movement of said piston relative to said control member at other positions of said control member and said piston, wherein said gas passage means is closed at a certain position of said piston stroke by movement of said piston that reduces said compression volume, said certain position being adjustable by adjustment of the position of said control member relative to said engine block;

an enclosed gas volume communicating with said gas passage means at the other end thereof;

a translation mechanism for moving said control member relative to said engine block kinematically independent of the movement of said piston for adjusting the position in said piston stroke when said communication between said gas passage means and said compression volume is closed, whereby the effective volume of said compression volume, and hence the engine power, can be controlled.

2. The power control defined in claim 1, wherein said control member is a sleeve having an externally threaded portion threadedly engaged with an internally threaded portion of said cylinder, and said translation mechanism includes means for rotating said sleeve relative to said cylinder to cause said sleeve to translate axially as said threaded portions rotate relatively.

3. The power control defined in claim 2, wherein said rotating means includes a threaded control rod extending transversely of the axis of said cylinder, and a gear non-rotatably attached to said sleeve and threadly engaged with said control rod, whereby movement of said control rod causes said gear and said sleeve to rotate.

4. The power control defined in claim 3, wherein said gear teeth are axially elongated whereby said gear engages said control rod at all axial positions of said sleeve throughout its full range of operation.

5. The power control defined in claim 1, wherein said control member includes a sleeve coaxially mounted for axial translation in said cylinder; said gas passage means includes ports in said sleeve, and a manifold in said cylinder communicating with said ports at all axial positions of said sleeve; said piston oscillates relative to said control member and closes said ports at selected positions in the piston travel.

6. The power control defined in claim 1, further comprising a piston rod attached to said piston and extending through said bore in said control member, said gas passage means including a section of said piston rod which is relieved to permit gas to flow therealong between said bore and said piston rod to an opening leading to said enclosed gas volume, said control member being axially movable to control the position on the stroke of said piston rod at which said relieved section of said piston rod is covered by said control member to thereby control the effective volume of said compression space volume.

7. In a Stirling engine, including at least one cylinder, gas acting means in said cylinder reciprocally mounted for oscillation between an expansion space and a compression space for cyclically circulating a working gas contained within said cylinder through a heater, a regenerator and a cooler to create a pressure wave, and for moving under the influence of said pressure wave to produce output power, and for moving in said cylinder to compress the working gas; wherein the improvement resides in a power control device; comprising:

an annular sleeve slidably disposed for axial movement in said cylinder to selected positions relative to the lowermost position of said gas acting means;

a port extending through said sleeve for establishing communication between said compression space and a chamber adapted to be pressurized to the engine working gas charge pressure;

a translation mechanism for moving said sleeve to selected axial positions in said cylinder kinematically independent of the oscillating position of said gas acting means so as to adjust the axial position of said sleeve port;

whereby the commencement of the compression phase of the Stirling cycle can be controlled by the position of said ports, and the magnitude of said pressure wave and therefore the engine power, can thereby be controlled.

8. The device defined in claim 7, wherein said translation mechanism includes an externally threaded section on said sleeve and an internally threaded section in said cylinder, whereby rotation of said sleeve about its axis will cause axial translation of said sleeve.

9. The device defined in claim 8, wherein said translation mechanism further includes a set of axially elongated, angularly spaced teeth formed on said sleeve, and an elongated control rod having teeth engaged with said set of teeth on said sleeve whereby movement of said control rod causes rotation of said sleeve about its axis.

10. The device defined in claim 7, wherein said sleeve includes a second set of ports extending therethrough and communicating between said compression space and said cooler.

11. The device defined in claim 7, wherein said gas-acting means includes a power piston, a piston rod connected to said power piston and linked to a reciprocating-to-rotating motion conversion apparatus; a rod seal is disposed around said piston rod and contained in a seal block for preventing leakage of working gas out of said cylinder; said sleeve engages said seal block for movement therewith, and said translation mechanism moves said seal block.

12. The device defined in claim 11, wherein said translation mechanism includes an externally threaded section on said seal block and an internally threaded section in said cylinder, whereby rotation of said seal block about its axis will cause axial translation of said seal block and said sleeve.

13. The device defined in claim 12, wherein said translation mechanism further includes a set of axially elongated, angularly spaced teeth formed on said seal block and an elongated control rod having teeth engaged with said set of teeth on said seal block whereby movement of said control rod causes rotation of said seal block about its axis.

14. The device defined in claim 7, further comprising: an annular manifold around said cylinder of such axial width that communication is established between said sleeve port and said manifold at all axial positions of said sleeve, and a gas conduit communication between said manifold and said chamber.

15. The device defined in claim 7, wherein said chamber is a crankcase of said engine, and further comprising means for preventing oil from entering said sleeve from said crankcase.

* * * * *

UNITED STATES PATENT AND TRADEMARK OFFICE

CERTIFICATE OF CORRECTION

PATENT NO. : 4,487,020

DATED : 12/11/84

INVENTOR(S) : John J. Dineen

It is certified that error appears in the above-identified patent and that said Letters Patent are hereby corrected as shown below:

Column 3, line 25, "portion" should read --port--;

line 46, "connected" should read --connects--.

Column 4, line 59, "coil" should read --oil--.

Column 5, line 66, "plston" should read --piston--;

line 68, "notion" should read --motion--.

Column 8, line 20, "94" should read --194--.

Column 11, line 60, delete "space".

Signed and Sealed this

*Twenty-eighth* Day of *May 1985*

[SEAL]

*Attest:*

DONALD J. QUIGG

*Attesting Officer*

*Acting Commissioner of Patents and Trademarks*